US011178906B2

(12) United States Patent
Lang et al.

(10) Patent No.: US 11,178,906 B2
(45) Date of Patent: Nov. 23, 2021

(54) AEROSOL-GENERATING ARTICLE HAVING IMPROVED WRAPPER

(71) Applicant: Philip Morris Products S.A., Neuchatel (CH)

(72) Inventors: Gerhard Lang, Murten (CH); Alexandre Malgat, Les Tuileries de Granson (CH); Aline Vuarnoz-Bize, Lentigny (CH)

(73) Assignee: Philip Morris Products S.A., Neuchatel (CH)

( * ) Notice: Subject to any disclaimer, the term of this patent is extended or adjusted under 35 U.S.C. 154(b) by 294 days.

(21) Appl. No.: 16/322,788

(22) PCT Filed: Aug. 10, 2017

(86) PCT No.: PCT/EP2017/070381
§ 371 (c)(1),
(2) Date: Feb. 1, 2019

(87) PCT Pub. No.: WO2018/033477
PCT Pub. Date: Feb. 22, 2018

(65) Prior Publication Data

US 2019/0200669 A1 Jul. 4, 2019

(30) Foreign Application Priority Data

Aug. 17, 2016 (EP) ..... 16184601

(51) Int. Cl.
*A24D 1/02* (2006.01)
*A24F 47/00* (2020.01)
(Continued)

(52) U.S. Cl.
CPC ..... *A24D 1/02* (2013.01); *A24C 5/01* (2020.01); *A24D 1/20* (2020.01)

(58) Field of Classification Search
None
See application file for complete search history.

(56) References Cited

U.S. PATENT DOCUMENTS 3,403,690 A 10/1968 Horsewell et al.
3,550,600 A 12/1970 Horsewell et al.
(Continued)

FOREIGN PATENT DOCUMENTS

CN 1312038 A 9/2001
CN 1324968 A 12/2001
(Continued)

OTHER PUBLICATIONS

Kuwabara et al., "Heat-not-burn tobacco, electronic cigarettes, and combustible cigarette use among Japanese adolescents:a nationwide population survey",BMC Pub Health,2017,[online],retr from Internet,[retr Jul. 18, 21],<URL:https://bmcpublichealth.biomedcentral.com/track/pdf/10.1186/s12889-020-08916-x.pdf> (Year: 2017).*
(Continued)

*Primary Examiner* — Dennis R Cordray
(74) *Attorney, Agent, or Firm* — Oblon, McClelland, Maier & Neustadt, L.L.P.

(57) ABSTRACT

A wrapper for a heat-not-burn article including an aerosol-forming tobacco substrate is provided, the wrapper including a sulphide scavenger compound, the sulphide scavenger compound being a metal salt, the metal salt being a carbonate, chloride, sulphate, hydroxide, nitrate, malate, acetate, citrate, or bromide, and the sulphide scavenger compound being based on a transition metal.

12 Claims, 1 Drawing Sheet

Figure 1:
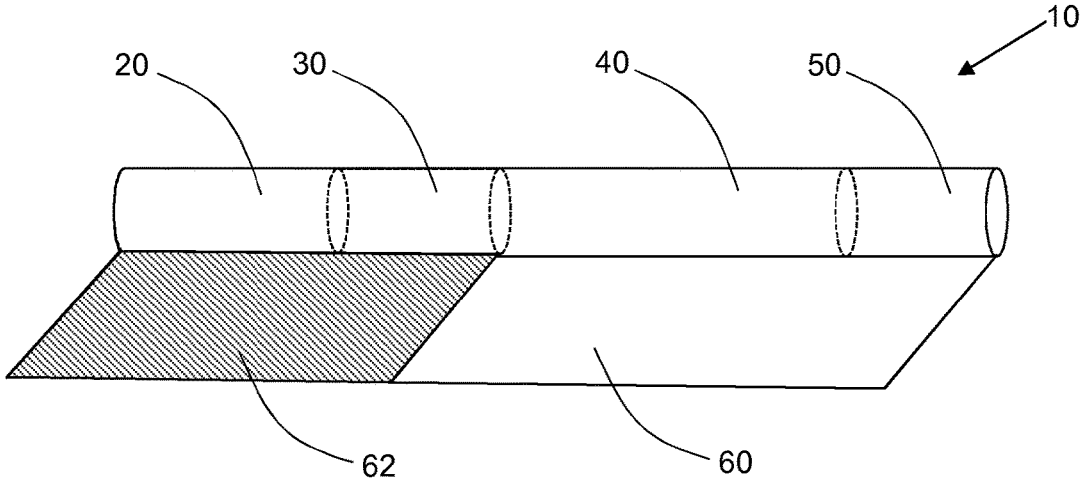

(51) Int. Cl.
*A24C 5/01* (2020.01)
*A24D 1/20* (2020.01)

(56) References Cited

U.S. PATENT DOCUMENTS

| | | | | |
|---|---|---|---|---|
| 4,015,610 | A | 4/1977 | Pasche | |
| 4,266,561 | A | 5/1981 | Litzinger | |
| 6,615,840 | B1 | 9/2003 | Fournier et al. | |
| 6,848,449 | B2 * | 2/2005 | Kitao | A24D 1/025 131/65 |
| 2003/0154991 | A1 | 8/2003 | Fournier et al. | |
| 2005/0016549 | A1 | 1/2005 | Banerjee et al. | |
| 2005/0051185 | A1 | 3/2005 | Rasouli et al. | |
| 2005/0121047 | A1 | 6/2005 | Saoud et al. | |
| 2005/0263163 | A1 | 12/2005 | Yadav et al. | |
| 2007/0000505 | A1 | 1/2007 | Zhuang et al. | |
| 2007/0023056 | A1 * | 2/2007 | Cantrell | A24F 47/004 131/194 |
| 2007/0095358 | A1 | 5/2007 | Li et al. | |
| 2007/0246054 | A1 | 10/2007 | Gedevanishvili et al. | |
| 2007/0251658 | A1 | 11/2007 | Gedevanishvili et al. | |
| 2009/0139534 | A1 | 6/2009 | Saoud et al. | |
| 2012/0012122 | A1 | 1/2012 | Yadav et al. | |
| 2013/0146075 | A1 | 6/2013 | Poget et al. | |
| 2015/0083148 | A1 | 3/2015 | Poget et al. | |
| 2016/0066618 | A1 | 3/2016 | Gedevanishvili et al. | |
| 2016/0198760 | A1 | 7/2016 | Li et al. | |
| 2016/0205996 | A1 | 7/2016 | John et al. | |
| 2017/0181469 | A1 | 6/2017 | Poget et al. | |

FOREIGN PATENT DOCUMENTS

| | | | |
|---|---|---|---|
| CN | 1805696 | A | 7/2006 |
| CN | 102639625 | A | 8/2012 |
| CN | 105744848 | A | 7/2016 |
| EP | 2 077 731 | B1 | 8/2011 |
| JP | H2-180634 | | 7/1990 |
| JP | H5-15732 | | 1/1993 |
| JP | 2011-517574 | | 6/2011 |
| JP | 2019-528064 | | 10/2019 |
| RU | 2 248 738 | C2 | 3/2005 |
| RU | 148 410 | U1 | 12/2014 |
| WO | WO 2004/002247 | A2 | 1/2004 |
| WO | WO 2004/086888 | A2 | 10/2004 |
| WO | WO 2011/117750 | A2 | 9/2011 |
| WO | WO 2013/098405 | A2 | 7/2013 |
| WO | WO 2013/178766 | A1 | 12/2013 |
| WO | WO 2013/178767 | A1 | 12/2013 |
| WO | WO 2013/190036 | A1 | 12/2013 |
| WO | WO 2015/028812 | A1 | 3/2015 |
| WO | WO 2018/033476 | A1 | 2/2018 |

OTHER PUBLICATIONS

Decision to Grant dated Oct. 20, 2020 in Russian Patent Application No. 2019107173/03(013795) (with English language translation), 16 pages.

International Search Report and Written Opinion dated Oct. 17, 2017 in PCT/EP2017/070381 filed on Aug. 10, 2017.

Combined Chinese Office Action and Search Report dated Feb. 3, 2021 in corresponding Chinese Patent Application No. 201780045827.6 (with English Translation), 22 pages.

Japanese Office Action dated Aug. 23, 2021 in corresponding Japanese Patent Application No. 2019-504109 (with English translation), citing documents AO-AR therein, 7 pages.

Combined Chinese Office Action and Search Report dated Sep. 13, 2021 in corresponding Chinese Patent Application No. 201780045827.6 (with English translation), citing documents AA, AO and AX therein, 20 pages.

Ji Yang, et al. "Comparative Analysis of Volatile Components in Novel and Traditional Cigarettes by HS-GC/MS", Tobacco Science & Technology, vol. 48, No. 11, Nov. 2015, 7 pages.

* cited by examiner

AEROSOL-GENERATING ARTICLE HAVING IMPROVED WRAPPER

The present invention relates to a novel wrapper for an aerosol-generating article and to an aerosol-generating article incorporating such a wrapper.

A number of smoking articles in which tobacco is heated rather than combusted have been proposed in the art. One aim of such heated smoking articles is to reduce known harmful smoke constituents of the type produced by the combustion and pyrolytic degradation of tobacco in conventional cigarettes.

Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the user.

A number of prior art documents disclose aerosol-generating devices for consuming or smoking heated smoking articles. Such devices include, for example, electrically heated aerosol-generating devices in which an aerosol is generated by the transfer of heat from one or more electrical heating elements of the aerosol-generating device to the aerosol-forming substrate of a heated smoking article. One advantage of such electrical smoking systems is that they significantly reduce sidestream smoke, while permitting a user to selectively suspend and reinitiate smoking.

During the use of electrically heated aerosol-generating devices, the power supplied to the heating element is controlled in order to achieve a specific heating profile that provides a substantially consistent aerosol delivery to the consumer over time. During a first phase of the heating profile, referred to herein as the "pre-heating phase", power is provided to the heating element to raise it to from the ambient temperature to a first temperature, at which aerosol is generated from the aerosol-forming substrate. In many devices, it is desirable to generate aerosol with the desired constituents as soon as possible after activation of the device, since consumers do not want to have to wait for a significant period following activation of the device before having a first puff. For this reason, in the first phase, power may be supplied to the heating element to raise it to the first temperature as quickly as possible. Following the pre-heating phase, the heating profile shifts to a second heating phase in which power is supplied to the heating element to retain it at a second temperature, typically lower than the first temperature, to achieve a consistent delivery of aerosol to the consumer as the consumer puffs on the aerosol-generating article.

It has been found that during the pre-heating phase, certain compounds are released from the aerosol-forming substrate as it heats up, which produce an undesirable malodour that may be detected by the consumer. One of the main compounds causing this malodour has been identified as hydrogen sulphide, which has an unpleasant sulphurous odour. Other compounds such as methanethiol and carbonyl sulphide may also contribute to the malodour, although typically to a lesser extent.

It would be desirable to provide an aerosol-generating article with novel means for reducing malodour during the pre-heating phase. It would be particularly desirable to provide an aerosol-generating article having means for reducing malodour that can be incorporated without significant modification of the construction of the aerosol-generating article. It would further be desirable to provide such means for reducing malodour that can be incorporated with minimal impact on the smoking experience for the consumer.

According to a first aspect of the invention there is provided an aerosol-generating article comprising: an aerosol-forming tobacco substrate; and a wrapper circumscribing at least a part of the aerosol-generating article. The wrapper comprises a metal-based sulphide scavenger compound.

Preferably, the aerosol-generating article is an aerosol-generating article for use in an aerosol-generating device comprising a heating element. However, in other embodiments the aerosol-generating article may itself incorporate a heat source, such as a carbon heat source, for heating the aerosol-forming substrate.

According to a second aspect of the invention there is provided an aerosol-generating system comprising: an aerosol-generating device comprising a heating element; and an aerosol-generating article for use with the aerosol-generating device, the aerosol-generating article comprising: an aerosol-forming tobacco substrate; and a wrapper circumscribing at least a part of the aerosol-generating article. The wrapper comprises a metal-based sulphide scavenger compound.

According to a third aspect of the invention there is provided a wrapper for an aerosol-generating article comprising an aerosol-forming tobacco substrate, the wrapper comprising a metal-based sulphide scavenger compound.

According to a fourth aspect of the invention there is provided a use of a sulphide scavenger compound based on a transition metal salt in the wrapper of a heated aerosol-generating article to reduce the level of hydrogen sulphide released during heating of the aerosol-generating article.

Features described below in relation to one aspect or embodiment of the invention may also be applicable to other aspects and embodiments. For example, features described in relation to the wrapper of aerosol-generating articles according to the invention will typically also be applicable to the wrapper of the aerosol-generating articles of aerosol-generating systems according to the invention and to wrappers according to the invention.

As used herein, the term "heated aerosol-generating article" refers to a heat-not-burn article comprising an aerosol-forming substrate that, when heated, releases volatile compounds that can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the term "aerosol-generating device" refers to a device that interacts with an aerosol-forming substrate of an aerosol-generating article to generate an aerosol.

As used herein, the terms "upstream" and "downstream" are used to describe the relative positions of elements, or portions of elements, of the aerosol-generating article in relation to the direction in which a user draws on the aerosol-generating article during use thereof.

As used herein, the term "sulphide scavenger compound" refers to a compound that has the potential to chemically react with sulphide compounds such as hydrogen sulphide to convert them into a less volatile form. Certain sulphide scavenger compounds may additionally act to reduce other sulphur compounds, including for example mercaptans, such as methanethiol.

Aerosol-generating articles according to the present invention incorporate a sulphide scavenger compound into the wrapper which acts to remove at least a proportion of the hydrogen sulphide released from the aerosol-forming substrate during the pre-heating phase described above. The hydrogen sulphide is thereby prevented from reaching the consumer such that the malodour during pre-heating can be effectively reduced or eliminated.

By providing the sulphide scavenger compound in a wrapper circumscribing the aerosol-generating article, the sulphide scavenger compound is advantageously positioned to come into contact with the sulphide compounds that are released from the aerosol-forming substrate during pre-heating.

The sulphide scavenger compound can advantageously be incorporated into the wrapper prior to the assembly of the aerosol-generating article so that the construction and manufacture of the aerosol-generating article are substantially unaffected. The incorporation of the sulphide scavenger compound into the wrapper means that the impact on the composition of the aerosol delivered to the consumer during use is minimised.

In aerosol-generating articles according to the invention, the sulphide scavenger compound is preferably incorporated into the outer wrapper circumscribing the aerosol-generating article. Alternatively or in addition, the sulphide scavenger compound may be incorporated into one or more plug wraps circumscribing the components of the aerosol-generating article beneath the outer wrapper. Preferably, where the sulphide scavenger compound is incorporated into one or more plug wraps, the sulphide scavenger compound is incorporated into at least the plug wrap circumscribing the aerosol-forming substrate.

As defined above, the wrapper of aerosol-generating articles according to the invention incorporates a sulphide scavenger compound that is metal-based. This means that the compound comprises a metal as one of the main constituents. Preferably, the wrapper comprises a sulphide scavenger compound selected from the group consisting of: a metal salt, a metal complex, or combinations thereof.

Preferably, the sulphide scavenger compound is based on a transition metal. The term "transition metal" is used herein to refer to a metal in the d-block of the Periodic table. Preferably, the transition metal is selected from the group consisting of zinc, iron and copper. In particularly preferred embodiments, the sulphide scavenger compound is based on zinc.

In embodiments in which the sulphide scavenger compound is a metal salt, any suitable salt may be used, which can be selected by the skilled person depending on the metal. For example, the metal salt may be a carbonate, chloride, sulphate, hydroxide, nitrate, malate, acetate, citrate or bromide.

In embodiments in which the sulphide scavenger compound is a metal complex, any suitable complex may be used, which can be selected by the skilled person depending on the metal. For example, the metal complex may be a chelate complex such as a complex with ethylenediaminetetraacetic acid (EDTA) or its conjugate bases.

Suitable zinc based sulphide scavenger compounds include but are not limited to: zinc carbonate, basic zinc carbonate, zinc chloride, zinc sulphate, zinc chelate such as zinc EDTA, zinc carboxylate such as zinc acetate and zinc bromide.

Suitable iron based sulphide scavenger compounds include but are not limited to: iron sulphate.

Suitable copper based sulphide scavenger compounds include but are not limited to: cupric carbonate, cupric sulphate, cupric nitrate, cupric chloride and copper complexes of chlorophyls or chlorophyllins.

Suitable tin based scavenger compounds include but are not limited to: stannous fluoride, stannous chloride and stannous bromide.

The sulphide scavenger compound may be incorporated into or onto the wrapper in a variety of different ways. The sulphide scavenger compound may be incorporated directly into or onto the wrapper, for example, in the form of a solid powder. Alternatively, the sulphide scavenger compound may be combined with a suitable binder, for example, a polymeric binder. This may facilitate the application of the sulphide scavenger compound into or onto the wrapper. Suitable polymeric binders include but are not limited to PVA and cellulosic binders.

In certain embodiments, the sulphide scavenger compound is incorporated in an outer layer provided on at least one surface of the wrapper. For example, the wrapper may be coated by an outer layer of the sulphide scavenger compound provided on the inside or outside or both the inside and outside of the wrapper with respect to the aerosol-forming substrate. The outer layer is preferably applied to the surface or surfaces of the wrapper in the form of a solution incorporating the sulphide scavenger compound. The sulphide scavenger compound may be applied to the wrapper together with a polymeric binder, as described above.

In alternative embodiments, the wrapper is formed of a sheet of fibrous material such as paper, wherein the sulphide scavenger compound is dispersed within the fibrous material. In such embodiments, the sulphide scavenger compound is typically added as a filler during production of the sheet of fibrous material. For example, where the sheet of fibrous material is paper, the sulphide scavenger compound can be added into the pulp during the paper-making process.

In further alternative embodiments, the sulphide scavenger compound is impregnated into the wrapper. In such embodiments, the sulphide scavenger compound is impregnated into the structure of the wrapper, in contrast to a coating layer as described above, in which the sulphide scavenger compound is provided in a layer on the surface of the wrapper. The impregnation of the sulphide scavenger compound is typically achieved by pressing to incorporate the sulphide scavenger compound into an existing wrapper, for example, using one or more rollers. The sulphide scavenger compound will typically be impregnated in the form of a solution.

The wrapper preferably incorporates at least about 0.01 percent by weight of the metal component of the sulphide scavenger compound, more preferably at least about 0.1 percent by weight, more preferably at least about 0.25 percent by weight based on the total combined weight of the wrapper and the sulphide scavenger compound. This effectively corresponds to the "concentration" by weight of the metal component in the wrapper. Alternatively or in addition, the wrapper preferably incorporates no more than about 5 percent by weight of the metal component of the sulphide scavenger compound, more preferably no more than about 4 percent by weight, based on the total combined weight of the wrapper and the sulphide scavenger compound. Preferably the wrapper incorporates between about 0.01 percent and about 5 percent by weight of the metal component of the sulphide scavenger compound, more preferably between about 0.1 percent and about 4 percent by weight, more preferably between about 0.25 percent and about 4 percent by weight, based on the total combined weight of the wrapper and the sulphide scavenger compound.

The wrapper preferably incorporates at least about 0.25 micrograms of the metal component of the sulphide scavenger compound per square centimetre of the wrapper, preferably at least about 2.5 micrograms per square centimetre of the wrapper, more preferably at least about 5 micrograms per square centimetre over the area of the wrapper into which the sulphide scavenger compound is incorporated. Alternatively or in addition, the wrapper preferably incorporates no more than about 125 micrograms of the metal component of the sulphide scavenger compound per square centimetre of the wrapper, preferably no more than about 100 micrograms per square centimetre of the wrapper. Preferably the wrapper incorporates between about 0.25 micrograms and about 125 micrograms of the metal component of the sulphide scavenger compound per square centimetre of the wrapper, more preferably between about 2.5 micrograms and about 100 micrograms per square centimetre and more preferably between about 5 micrograms and about 100 micrograms per square centimetre, over the area of the wrapper into which the sulphide scavenger compound is incorporated. These preferred values are based on a wrapper having a basis weight of about 25 grams per square metre.

The wrapper of a single aerosol-generating article according to the invention preferably incorporates a total amount of the metal component of the sulphide scavenger compound of between about 10 micrograms and about 700 micrograms, more preferably between about 15 micrograms and about 500 micrograms.

Preferably, the sulphide scavenger compound is incorporated in a sufficient amount to achieve a reduction of at least about 30 percent by weight of hydrogen sulphide during a pre-heating test compared with an equivalent aerosol-generating article without the sulphide scavenger compound in the wrapper, more preferably at least about 50 percent, most preferably at least about 70 percent. For the purposes of such a comparison, both the aerosol-generating article with and without the sulphide scavenger compound in the wrapper are pre-heated in a pre-heating test as defined below.

In the pre-heating test, an aerosol-generating article is inserted into an aerosol-generating device comprising a heating element for heating the aerosol-forming substrate of the aerosol-generating article. The heating element is programmed to heat at 350 degrees Celsius for 30 seconds and then switch off, to simulate the pre-heating phase of the aerosol-generating article during normal use. During the heating of the aerosol-generating article, the aerosol-generating article is placed in a sealed glass vial so that the gas phase constituents released from the aerosol-generating article during heating are collected. A sample of the gas phase constituents collected within the vial is then removed and the concentration of hydrogen sulphide is determined using a liquid chromatography-mass spectrometry method. A suitable aerosol-generating device for the pre-heating test is the iQOS® heat-not-burn device from Philip Morris International, which is commercially available.

In preferred embodiments of the invention, the aerosol-generating article is adapted for use with an aerosol-generating device comprising a heating element. In such embodiments, the aerosol-forming substrate is preferably adapted to be penetrated by the heating element of an aerosol-generating device into which the aerosol-generating article is inserted during smoking. Where a front-plug is provided upstream of the aerosol-forming substrate, the front-plug may be adapted to be penetrated by the heating element.

In alternative embodiments of the invention, the aerosol-generating article may incorporate a heat source adjacent to the aerosol-forming substrate such that a separate aerosol-generating device is not required.

The aerosol-forming substrate of aerosol-generating articles according to the invention comprises tobacco. Preferably, the aerosol-forming substrate is a solid aerosol-forming substrate. The aerosol-forming substrate may comprise both solid and liquid components.

In a preferred embodiment, the aerosol-forming substrate comprises homogenised tobacco material. Preferably, the aerosol-forming substrate comprises a gathered sheet of homogenised tobacco material. As used herein, the term "homogenised tobacco material" denotes a material formed by agglomerating particulate tobacco.

Aerosol-generating articles according to the invention preferably further comprise a support element located immediately downstream of the aerosol-forming substrate so that the aerosol-forming substrate and the support element abut each other in an axial direction. The support element preferably prevents downstream movement of the aerosol-forming substrate when the upstream end of the aerosol-generating article is inserted into a device requiring insertion force, such as may be required when inserting the aerosol-generating article into a device having a heating element configured to penetrate the aerosol-forming substrate.

The aerosol-forming substrate is preferably located at the upstream end of the aerosol-generating article. Alternatively, a front-plug may be incorporated upstream of the aerosol-forming substrate.

Aerosol-generating articles according to the invention may further comprise an aerosol-cooling element located downstream of the support element. As used herein, the term "aerosol-cooling element" describes an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol-cooling elements.

Alternatively or in addition, aerosol-generating articles according to the invention may further comprise a mouthpiece located at the downstream end of the aerosol-generating article. The mouthpiece may comprise a filter. The filter may be formed from one or more suitable filtration materials. Many such filtration materials are known in the art. In one embodiment, the mouthpiece may comprise a filter formed from cellulose acetate tow.

Suitable aerosol-forming substrates, support elements, aerosol-cooling elements and mouthpieces are described in WO-A-2013/098405.

As set out above, the wrapper incorporating the sulphide scavenger compound circumscribes at least a portion of the aerosol-generating article. Preferably, the wrapper (or the region of the wrapper incorporating the sulphide scavenger compound) is provided around at least part of the portion of the aerosol-generating article that is adapted to be received into an aerosol-generating device. The sulphide scavenger compound is therefore provided in the region of the aerosol-generating article from which the hydrogen sulphide will be emitted. The portion of the aerosol-generating article that is adapted to be received into the aerosol-generating device typically includes the aerosol-forming substrate and the support element downstream of the aerosol-forming substrate, where present. Where present, the aerosol-cooling element may also be inserted into the aerosol-generating device. The mouthpiece, where present, will typically not be inserted into the aerosol-generating device.

Preferably, the wrapper or the portion of the wrapper incorporating the sulphide scavenger compound circumscribes at least the aerosol-forming substrate of the aerosol-generating article. With such an arrangement, the sulphide scavenger compound is provided in the immediate vicinity of the aerosol-forming substrate from which the hydrogen sulphide will be generated. Therefore, the sulphide scavenger compound is well positioned to come into contact with the hydrogen sulphide as it is released during the pre-heating phase such that it can be trapped or reacted into a more inert form before being detected by the consumer. Alternatively or in addition, the wrapper incorporating the sulphide scavenger compound may circumscribe the support element downstream of the aerosol-forming substrate, where present.

The wrapper incorporating the sulphide scavenger compound may circumscribe only a part of the aerosol-generating article, with the remainder of the aerosol-generating article circumscribed by one or more additional wrappers that do not contain a sulphide scavenger compound. Alternatively, the wrapper incorporating the sulphide scavenger compound may circumscribe the aerosol-generating article along substantially the full length.

In certain embodiments, the sulphide scavenger compound may be provided only in certain defined areas or portions of the wrapper. For example, where the sulphide scavenger compound is applied in the form of a coating layer, the coating layer may only be applied to certain areas of the wrapper, such as those that are proximate the aerosol-forming substrate. In other embodiments, the sulphide scavenger compound may be provided throughout substantially the entire wrapper.

The wrapper of the aerosol-generating article according to the present invention is formed of a sheet material incorporating the sulphide scavenger compound in some way, as described above. The wrapper is preferably a sheet of a fibrous material and particularly preferably, a sheet of paper.

Aerosol-generating systems according to the present invention comprise an aerosol-generating article as described in detail above in combination with an aerosol-generating device which is adapted to receive the upstream end of the aerosol-generating article during smoking. The aerosol-generating device comprises a heating element which is adapted to heat the aerosol-forming substrate in order to generate an aerosol during use. Preferably, the heating element is adapted to penetrate the aerosol-forming substrate when the aerosol-generating article is inserted into the aerosol-generating device.

Preferably, the aerosol-generating device additionally comprise a housing, an electrical power supply connected to the heating element and a control element configured to control the supply of power from the power supply to the heating element. It is this control element which controls the heating to produce the heating profile including the pre-heating phase discussed above.

Suitable aerosol-generating devices for use in the aerosol-generating system of the present invention are described in WO-A-2013/098405.

The present invention further extends to a method for the production of an aerosol-generating article as described above. The method comprises the steps of: providing an aerosol-forming substrate; combining the aerosol-forming substrate with one or more components to form an aerosol-generating article; and wrapping the aerosol-generating article with an outer wrapper comprising a metal-based sulphide scavenger compound. Such methods produce aerosol-generating articles with the sulphide scavenger compound in the outer wrapper.

In an alternative method according to the present invention, the method comprises the steps of: providing an aerosol-forming substrate circumscribed by a plug wrap comprising a metal-based sulphide scavenger compound; combining the aerosol-forming substrate with one or more components to form an aerosol-generating article; and wrapping the aerosol-generating article with an outer wrapper. Such methods produce aerosol-generating articles with the sulphide scavenger compound in the plug wrap of the aerosol-forming substrate.

Methods according to the invention can advantageously be carried out using existing apparatus and techniques for assembling aerosol-generating articles, since the sulphide scavenger compound can be incorporated into the appropriate wrapper prior to the assembly of the aerosol-generating article. The wrapping of the wrapper around the aerosol-generating article can then be carried out in a conventional manner.

Figure 2:
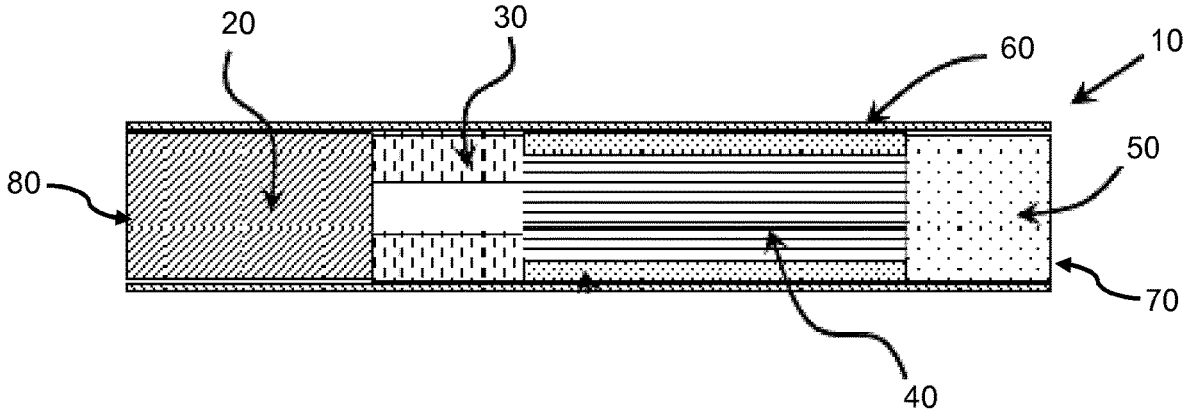

The invention will now be further described, by way of example only, with reference to the accompanying drawings in which:

FIG. 1 is a schematic view of an aerosol-generating article according to an embodiment of the invention, with the outer wrapper partially unwrapped; and FIG. 2 is a schematic cross-sectional view of the aerosol-generating article of FIG. 1.

The aerosol-generating article 10 shown in FIGS. 1 and 2 comprises four elements arranged in coaxial alignment: an aerosol-forming substrate 20, a support element 30, an aerosol-cooling element 40, and a mouthpiece 50. Each of the four elements is circumscribed by a corresponding plug wrap (not shown). These four elements are arranged sequentially and are circumscribed by an outer wrapper 60 to form the aerosol-generating article 10. The aerosol-generating 10 has a proximal or mouth end 70, which a user inserts into his or her mouth during use, and a distal end 80 located at the opposite end of the aerosol-generating article 10 to the mouth end 70.

In use, air is drawn through the aerosol-generating article 10 by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-forming substrate 20 is located at the extreme distal or upstream end of the aerosol-generating article 10. In the embodiment illustrated in FIG. 1, aerosol-forming substrate 20 comprises a gathered sheet of crimped homogenised tobacco material circumscribed by a wrapper. The crimped sheet of homogenised tobacco material comprises comprising glycerine as an aerosol-former.

The support element 30 is located immediately downstream of the aerosol-forming substrate 20 and abuts the aerosol-forming substrate 20. In the embodiment shown in FIG. 1, the support element is a hollow cellulose acetate tube. The support element 30 locates the aerosol-forming substrate 20 at the extreme distal end 80 of the aerosol-generating article 10 so that it can be penetrated by a heating element of an aerosol-generating device. As described further below, the support element 30 acts to prevent the aerosol-forming substrate 20 from being forced downstream within the aerosol-generating article 10 towards the aerosol-cooling element 40 when a heating element of an aerosol-generating device is inserted into the aerosol-forming substrate 20. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 1, the mouthpiece 50 comprises a conventional cellulose acetate tow filter of low filtration efficiency.

The outer wrapper 60 is a sheet of cigarette paper which has been impregnated with a solution of a sulphide scavenger compound in the region 62 of the outer wrapper (shaded in FIG. 1) overlying the aerosol-forming substrate 20 and the support element 30. Examples of suitable sulphide scavenger compounds are provided in Table 1 below.

To assemble the aerosol-generating article 10, the four elements described above are aligned and tightly wrapped within the outer wrapper 60. An optional row of perforations is provided in a region of the outer wrapper 60 circumscribing the support element 30 of the aerosol-generating article 10.

In the embodiment illustrated in FIG. 1, a distal end portion of the outer wrapper 60 of the aerosol-generating article 10 is circumscribed by a band of tipping paper (not shown).

The aerosol-generating article 10 illustrated in FIG. 1 is designed to engage with an aerosol-generating device comprising a heating element in order to be smoked or consumed by a user. In use, the heating element of the aerosol-generating device heats the aerosol-forming substrate 20 of the aerosol-generating article 10 to a sufficient temperature to form an aerosol, which is drawn downstream through the aerosol-generating article 10 and inhaled by the user.

During the pre-heating phase, the sulphide scavenger compound in the outer wrapper 60 acts to reduce the level of hydrogen sulphide emitted from the aerosol-forming substrate. In a pre-heating test as defined above, the reduction achieved is at least 30 percent compared to an aerosol-generating article of a similar construction but with an outer wrapper formed from a conventional cigarette paper. As demonstrated in the examples below, for many sulphide scavenger compounds, a reduction of up to 70 percent in the level of hydrogen sulphide can be achieved. Such a reduction in the level of hydrogen sulphide means that the malodour from the hydrogen sulphide is minimised and may not be detectable by the consumer at all.

In the specific embodiment described above, the sulphide scavenger compound is incorporated into the outer wrapper of the aerosol-generating article. However, the skilled person would appreciate that the sulphide scavenger compound could additionally or alternatively be incorporated into one or more of the plug wraps circumscribing the individual elements.

EXAMPLES

For each of the sulphide scavenger compounds shown below in Table 1, an aerosol-generating article according to the invention (as described above with reference to the figures) was produced, with 0.1 millilitres of a solution of the sulphide scavenger compound applied to the region 62 of the outer wrapper using a micropipette and spread evenly around the circumference of the aerosol-generating article. Each aerosol-generating article was subjected to the pre-heating test defined above.

The percentage reductions in hydrogen sulphide and methanethiol were measured relative to a control sample in which the solvent without the sulphide scavenger compound was applied in the same way to an aerosol-generating article of the same construction.

For each sulphide scavenger compound, the reduction shown is an average of the reductions measured over four samples.

It can be seen from the results below that for each sulphide scavenger compound, a reduction of approximately 70 percent of hydrogen sulphide was observed relative to the control sample. Significant reductions in methanethiol were also observed, in particular for the copper based scavenger compounds.

TABLE 1

| Sulphide scavenger compound | Amount of metal component (micrograms per square centimetre) | % Reduction in Hydrogen Sulphide | % Reduction in Methanethiol |
|---|---|---|---|
| Zinc chloride | 400 | 73 | 43 |
| Zinc chloride | 100 | 70 | 28 |
| Zinc chloride | 25 | 67 | 22 |
| Copper (II) Sulphate pentahydrate | 100 | 74 | 71 |
| Copper (II) Sulphate pentahydrate | 25 | 71 | 69 |
| Copper (II) Sulphate pentahydrate | 6.25 | 68 | 64 |

The invention claimed is:

1. A heat-not-burn article, comprising:

an aerosol-forming tobacco substrate; and a wrapper circumscribing at least a part of the heat-not-burn article, the wrapper comprising a sulphide scavenger compound, wherein the sulphide scavenger compound is a metal salt, wherein the metal salt is a carbonate, chloride, sulphate, hydroxide, nitrate, malate, acetate, citrate, or bromide, wherein the sulphide scavenger compound is based on a transition metal, and wherein an amount of a metal component of the sulphide scavenger compound in the wrapper is between 0.01 percent and 5 percent by weight based on a total weight of the wrapper and the sulphide scavenger compound.

2. The heat-not-burn article according to claim 1, wherein the sulphide scavenger compound is based on zinc or copper.

3. The heat-not-burn article according to claim 1, wherein the wrapper comprises the sulphide scavenger compound combined with a polymeric binder.

4. The heat-not-burn article according to claim 1, wherein an outer layer incorporating the sulphide scavenger compound is provided on at least one surface of the wrapper.

5. The heat-not-burn article according to claim 1, wherein the wrapper is formed of a sheet of a fibrous material, and wherein the sulphide scavenger compound is dispersed within the fibrous material.

6. The heat-not-burn article according to claim 1, wherein the sulphide scavenger compound is impregnated into the wrapper.

7. The heat-not-burn article according to claim 1, wherein an amount of a metal component of the sulphide scavenger compound in the wrapper is between 0.25 micrograms per square centimeter and 125 micrograms per square centimeter of the wrapper.

8. The heat-not-burn article according to claim 1, wherein the sulphide scavenger compound in the wrapper provides a reduction of at least 50 percent by weight of hydrogen sulphide during a pre-heating test compared with an equivalent heat-not-burn article without the sulphide scavenger compound in the wrapper, and wherein in the pre-heating test a heating element configured to heat the aerosol-forming substrate in the heat-not-burn article is programmed to heat at 350 degrees Celsius for 30 seconds and then to switch off.

9. The heat-not-burn article according to claim 1, wherein the wrapper comprising the sulphide scavenger compound is an outer wrapper.

10. An aerosol-generating system, comprising:

an aerosol-generating device comprising a heating element; and a heat-not-burn article for the aerosol-generating device, the heat-not-burn article being according to claim 1.

11. A method for the production of a heat-not-burn article according to claim 1, the method comprising:

providing an aerosol-forming tobacco substrate;

combining the aerosol-forming tobacco substrate with one or more components to form an aerosol-generating article; and wrapping the heat-not-burn article with an outer wrapper, the outer wrapper comprising:

a sulphide scavenger compound, wherein the sulphide scavenger compound is a metal salt, wherein the metal salt is a carbonate, chloride, sulphate, hydroxide, nitrate, malate, acetate, citrate, or bromide, wherein the sulphide scavenger compound is based on a transition metal, and wherein an amount of a metal component of the sulphide scavenger compound in the wrapper is between 0.01 percent and 5 percent by weight based on a total weight of the wrapper and the sulphide scavenger compound.

12. The method according to claim 11, wherein the outer wrapper comprises a sulphide scavenger compound based on a transition metal salt and is configured to reduce a level of hydrogen sulphide released during heating of the heat-not-burn article.

* * * * *